United States Patent [19]

Lakin

[11] 4,066,383

[45] Jan. 3, 1978

[54] SURFACE AERATION IMPELLER

[75] Inventor: Michael B. Lakin, Rochester, N.Y.

[73] Assignee: General Signal Corporation, Rochester, N.Y.

[21] Appl. No.: 697,519

[22] Filed: June 18, 1976

[51] Int. Cl.[2] ..... B01O 47/16

[52] U.S. Cl. ..... 416/186 R; 261/91

[58] Field of Search ..... 416/184–186, 416/186 A, 199; 261/91

[56] References Cited

U.S. PATENT DOCUMENTS

| | | | |
|---|---|---|---|
| 4,329 | 4/1871 | Case | 416/185 |
| 629,121 | 7/1899 | Bicalky | 416/184 |
| 1,048,025 | 12/1912 | Anthony | 416/87 |
| 1,649,161 | 11/1927 | Foster | 416/185 |
| 1,919,970 | 7/1933 | Woods | 416/184 |
| 3,341,450 | 9/1967 | Ciabattari et al. | 261/91 X |
| 3,576,316 | 4/1971 | Kaelin | 416/186 |
| 3,690,621 | 9/1972 | Tanaka | 416/184 |

FOREIGN PATENT DOCUMENTS

| | | | |
|---|---|---|---|
| 550,150 | 5/1958 | Italy | 416/186 |
| 6,918,698 | 6/1971 | Netherlands | 261/91 |

*Primary Examiner*—Everette A. Powell, Jr.
*Attorney, Agent, or Firm*—Jeffrey S. Mednick

[57] ABSTRACT

An impeller which is adapted to be affixed to a rotating shaft is provided for aerating a liquid and includes a support disk having a circular outer edge. The support disk is affixed to the rotating shaft in such a manner that it is maintained in a substantially perpendicular relationship with the shaft. A plurality of impeller blades are affixed to the support disk in such a manner as to be spaced from the shaft and extend above the upper surface of the support disk and below the lower surface of the support disk. The impeller blades further extend outwardly from the circular outer edge and have an upper edge which lies in a plane substantially parallel to the support disk. Each impeller blade which is tapered causing the blades to be widest at the portion closest to the rotating shaft and progressively more narrow as the blades extend outwardly from the support disk. Additionally each of the impeller blades includes a flow inducing fin along the lower edge of the blade, which fins are tapered so as to be widest at the portion closest to the rotating shaft and progressively more narrow as the blade extends radially outwardly from the support disk. A cover means is affixed to the impeller blades and spaced from the upper surface of the support disk for creating an air intake opening above the upper surface of the support disk and for reducing the amount of splashing caused by the rotation of the impeller near the surface of the liquid. In one embodiment the impeller includes means for adjustably securing the impeller blades to the support disk so that the degree of radial extension is adjustable and further includes means for adjustably securing the cover means to the upper edges of the impeller blades.

4 Claims, 5 Drawing Figures

SURFACE AERATION IMPELLER

BACKGROUND OF THE INVENTION

The present invention relates generally to rotating impellers and more particularly to an impeller designed to rotate near the surface of a liquid to aerate the liquid.

In recent years aerating impellers have been used quite extensively on the surface of liquid sewage for aerating the sewage. Typical of such aeration impellers are those shown in U.S. Pat. Nos. 3,479,017 to Thikotter; 3,576,316 and 3,610,590 to Kaelin; and 3,741,682 to Robertson. Although such devices have functioned in a generally satisfactory manner, problems have been experienced with excessive splashing and misting, insufficient pumping and circulation, and clogging of the impellers during operation. Additionally, these prior art impellers have been of a fixed diameter, and thus if a larger or smaller impeller were needed, an entire unit would have to be substituted in the field.

SUMMARY OF THE INVENTION

Accordingly, the present invention provides an impeller for aerating a liquid which is adapted to be affixed to a rotating shaft and includes a support disk having a circular outer edge. The support disk is affixed to the rotating shaft in such a manner that it is maintained in a substantially perpendicular relationship with the shaft. A plurality of impeller blades are affixed to the support disk in such a manner as to be spaced from the shaft and extend above the upper surface of the support disk and below the lower surface of the support disk. The impeller blades further extend outwardly from the circular outer edge and have an upper edge which lies in a plane substantially parallel to the support disk. Each impeller blade is tapered causing the blades to be widest at the portion closest to the rotating shaft and progressively more narrow as the blades extend outwardly from the support disk. Additionally, each of the impeller blades includes a flow inducing fin along the lower edge of a blade which fins are tapered so as to be widest at the portion closest to the rotating shaft and progressively more narrow as the blade extends outwardly from the support disk. A cover means is affixed to the impeller blades and spaced from the upper surface of the support disk for creating an air intake opening above the upper surface of the support disk and for reducing the amount of splashing caused by the rotation of the impeller near the surface of the liquid. In one embodiment the impeller includes means for adjustably securing the impeller blades to the support disk so that the degree of radial extension is adjustable and further includes means for adjustably securing the cover means to the upper edges of the impeller blades.

OBJECTS OF THE PRESENT INVENTION

Thus, an object of the present invention is the provision of an impeller for aerating a liquid which will produce a relatively low spray profile to thereby avoid excessive splashing and misting of the liquid.

Another object of the present invention is the provision of an impeller for aerating a liquid which will significantly increase the pumping and circulation of the liquid with respect to impellers heretofore available.

A further object of the present invention is the provision of an impeller for aerating a liquid which will operate in a relatively clog-free manner and permit easy access to the impeller interior.

Another object of the present invention is the provision of an impeller for aerating a liquid having circulation and aeration characteristics which are very sensitive to the level of the liquid.

Still another object of the present invention is the provision of an impeller for aerating a liquid which has a provision for permitting the diameter of the impeller to be varied.

A still further object of the present invention is the provision of an impeller for aerating a liquid which is relatively simple in construction and therefore easy and inexpensive to manufacture.

Other objects, advantages, and novel features of the present invention will become apparent from the following detailed description of the invention when considered in conjunction with the accompanying drawings.

DESCRIPTION OF THE PREFERRED EMBODIMENTS

Figure 2:
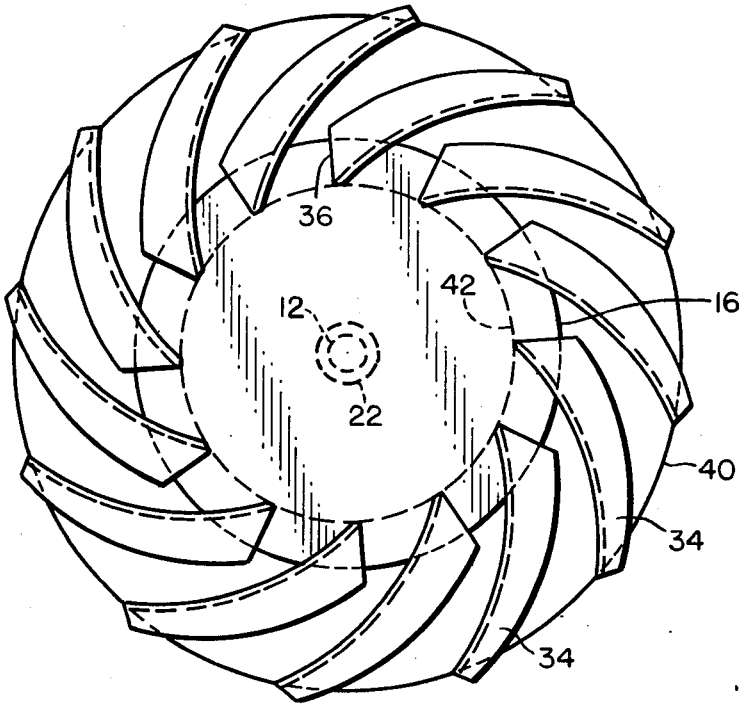
FIG. 2 shows a bottom plan view of the impeller shown in FIG. 1.
Figure 1:
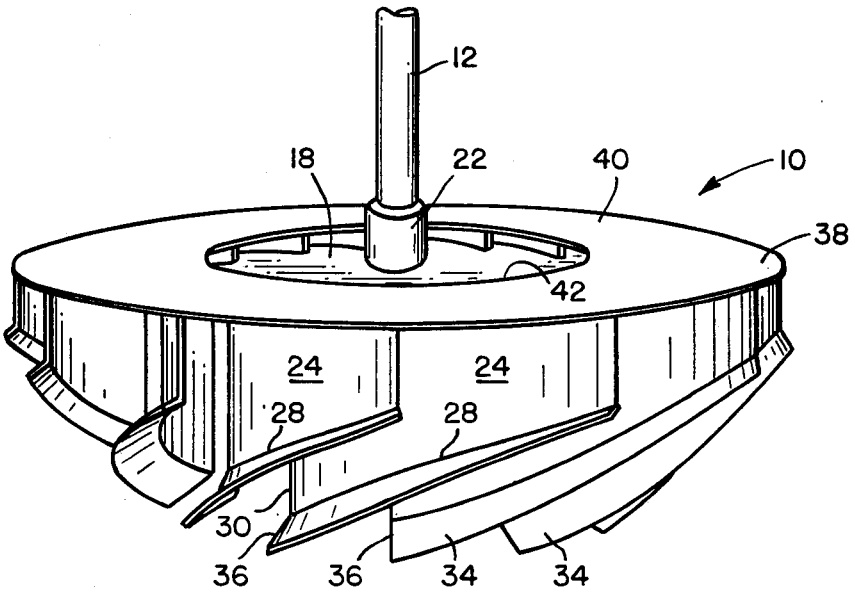
FIG. 1 shows a perspective view of the surface aeration impeller of the present invention.
Figure 3:
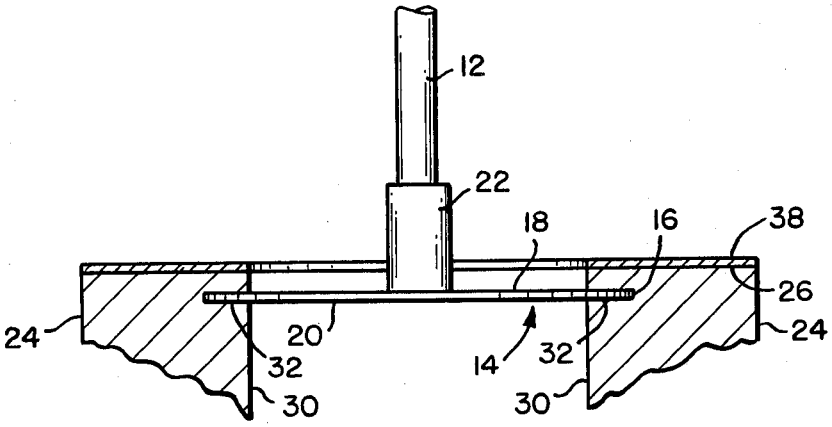
FIG. 3 shows a partial cross-sectional schematic view of the impeller shown in FIG. 1.

The surface aeration impeller of the present invention will now be described in detail with reference to FIGS. 1 through 5 of the drawings. A surface aeration impeller 10 for aerating a liquid is adapted to be affixed to a rotating shaft 12. The shaft 12 may be connected to any suitable prime mover (not shown). The impeller 10 includes a support disk 14 having a circular outer edge 16 and upper and lower surfaces 18 and 20, respectively. The surfaces 18 and 20 are preferably planar, although beveled surfaces would clearly fall within the scope of the present invention. Means are provided for affixing the support disk to the rotating shaft 12 so that the support disk 14 is maintained in a substantially perpendicular relationship with the shaft 12. This affixing means is preferably a hub 22 which may be affixed to the shaft 12 by means of a set screw.

A plurality of impeller blades 24 are affixed to the support disk 14 in such a manner as to be spaced from the shaft 12. The impeller blades 24 extend outwardly from the circular outer edge 16 and also extend above the upper disk surface 18 and below the lower disk surface 20. Additionally, each of the impeller blades 24 has an upper edge 26 which lies in a plane substantially parallel to the support disk 14. Each of the blades 24 is tapered in such a manner as to cause the blades 24 to be widest at that portion 30 which is closest to the rotating shaft 12 and become progressively more narrow as the blade 24 extends outwardly from the support disk 14. The impeller blades 24 are preferably curved along their entire length in the outward direction. Although from a theoretical standpoint many types of curved configurations might prove suitable, from an ease of manufacture standpoint it has proved preferable to make this curvature be of a fixed radius. It should be understood that the use of planar blades also falls within the scope of the present invention. As is most clearly shown in FIG. 3, the impeller blades 24 may include a notch 32 along the inner edge 30 which is adapted to receive the circular outer edge 16 of the support disk 14, so that the blades 24 may be securely fastened to the support disk 14 in a dovetail fashion. Thus, the blades 24 may be permanently affixed to the support disk 14. If for example, the blades 24 and the support disk 14 are made of steel, then the blades 24 may be welded to the support disk 14 along the notched portion 32.

Each of the impeller blades 24 includes a flow inducing fin 34 along the lower edge 28 of the blade 24. The fins 34 are also tapered so as to be widest at the portion 36 which is closest to the rotating shaft 12 and so as to become progressively more narrow as the blade 24 extends outwardly from the impeller. The fins 34 are also preferably curved to correspond to the shape of the blade 24.

The fins 34 and the blades 24 may be made of steel, in which case the fins may be welded to the blades 24 along the lower edge 28. In the alternative, the fins 34 and the blades 24 may be made of cast aluminum and thus be a unitary structure.

A cover means in the form of a covering disk 38 is affixed to the impeller blades 24 and spaced from the upper disk surface 18, for creating an air intake opening above the upper disk surface 18 and for reducing the amount of splashing caused by the rotation of the impeller near the surface of the liquid. The disk 38 preferably includes a circular outer edge 40 and a circular inner edge 42, which defines an aperture at the center of the disk. This aperture defines the air intake opening and permits the covering disk 38 to surround the rotating shaft 12. Due to manufacturing considerations, both upper and lower surfaces of the covering disk 38 are preferably planar. In the embodiment shown in FIG. 3, the covering disk 38 is permanently affixed to the top edges 26 of the blades 24, preferably by welding.

Figure 4:
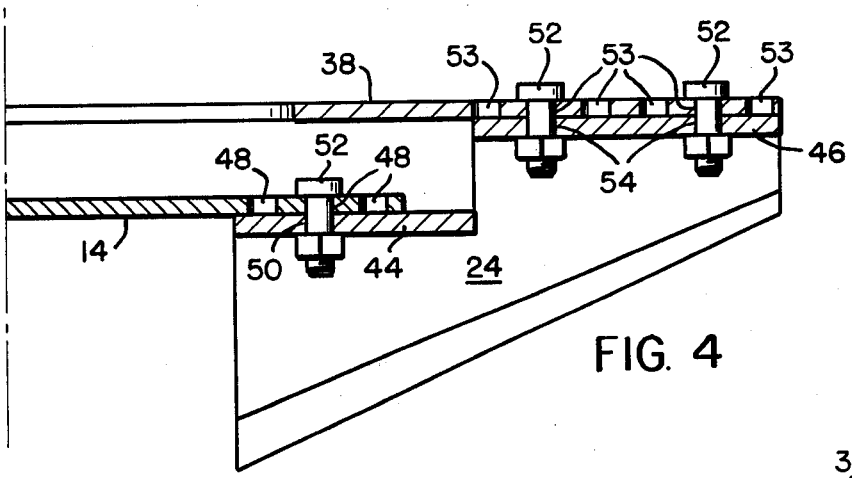
FIG. 4 shows a cross-sectional view of a second embodiment of the impeller shown in FIG. 1.
Figure 5:
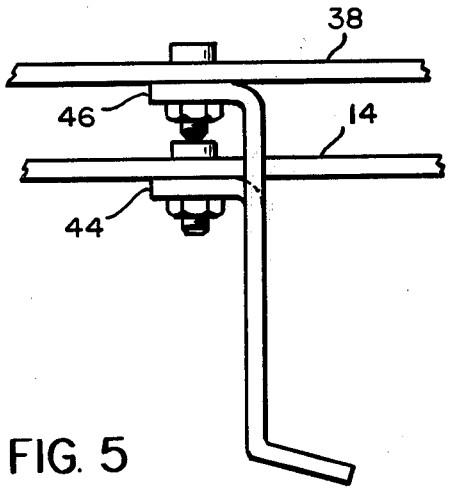
FIG. 5 shows an end view of the embodiment shown in FIG. 4.

Referring to FIGS. 4 and 5, a second embodiment of the surface aeration impeller of the present invention will now be described in detail. In connection with this description like numerals will be utilized to identify like components. This second embodiment is identical to the first embodiment described above with the exception that in the second embodiment means are provided for adjustably securing the impeller blades 24 to the support disk 14 so that the degree of radial extension of the blades 24 with respect to the disk 14 is adjustable. Additionally, means are provided for adjustably securing the covering disk 38 to the upper edges 26 of the impeller blades 24 so that the degree of radial extension of the blades 24 remains adjustable. For simplicity of illustration only, a planar blade has been shown in the embodiment shown in FIGS. 4 and 5. To achieve this adjustability, the impeller blades 24 include a pair of flanges 44 and 46 along a stepped top edge of the impeller blades 24. It should be understood that the flanges 44 may also be utilized with blades having a curved configuration and that the flanges 44 may be positioned on either side of the blade. When planar blades are used, gussets are preferably placed on the top surface of the blade opposite the flange, to provide added stability for the blade. The means for adjustably securing the impeller blades to the support disk 14 includes three radially aligned mounting holes 48 in the support disk 14 for each of the blades 24. It should be understood that if a further degree of adjustability is desired, additional holes may be added and the spacing between the holes may be changed. Additionally, the same result could be achieved by placing plural mounting holes in the flange 44. However, if the plural mounting holes are contained in the disk 14 then only a single mounting hole 50 need be contained in the flange 44. A suitable fastener 52, such as a nut and a bolt, may be inserted through the desired mounting holes to properly position the blade 24 with respect to the support disk 14. In a like manner, two sets of radially aligned mounting holes 53 are contained in the covering disk 38, and a pair of mounting holes 54 are contained in the flange 46 to thereby adjustably secure the covering disk 38 to the upper edges of the impeller blades. Once again, it should be understood that the number of mounting holes 53 and the spacing between the mounting holes could be altered to correspond to the desired degree of adjustability. Also, the plural mounting holes could be contained in the flange 46 instead of the disk 38. Yet another possible alternative would be to replace all but one set of the adjustable mounting holes 53 and 48 with slots to provide radial adjustability. In this embodiment the blades 24 are preferably made of cast aluminum so that the flanges 44 and 46 and the blade portion 24 comprise a unitary structure.

In the operation of the surface aeration impeller of the present invention, the impeller 10 is positioned near the surface of the liquid to be aerated. Since the impeller 10 will normally not be lowered to such an extent as to submerge the support disk 14 during rotation, input air enters the impeller through the aperture in the covering disk 38 defined by the edge 42 and may pass through the space between the disk 38 and the disk 14. Since the blades 24 are tapered and since the fins 34 are also tapered, as discussed above, and assuming that the prime mover for the shaft 12 provides a fixed degree of rotational input speed, the mixing power level and therefore the circulation and aeration characteristics of the impeller 10 may be adjusted rather easily by raising and lowering the impeller with respect to the surface of the liquid. The use of the covering disk 38 in combination with the flow inducing fins 34 creates a relatively low spray profile to thereby avoid excessive splashing and misting of the liquid being aerated. Furthermore, the shape of the blades 24 and the flow inducing fins 34 significantly increase the pumping and circulation action of the impeller 10 with respect to impellers which were heretofore available. Since the impeller 10 is of a relatively open construction which is most apparent from the bottom view shown in FIG. 2, the impeller operates in a relatively clog-free manner and permits easy access for servicing to the interior of the impeller. Should one desire to change the diameter of the impeller, it is merely necessary to reposition the fasteners 52 within the desired set of mounting holes. Thus, the diameter of the impeller may be easily adjusted after installation.

While there have been described what are at present considered to be the preferred embodiments of the present invention, it will be obvious to those skilled in the art that various changes and modifications may be made therein, without departing from the invention, and it is, therefore, aimed in the appended claims to cover all such changes and modifications as fall within the true spirit and scope of the invention.

What is claimed is:

1. An impeller for aerating a liquid and adapted to be affixed to a rotating shaft, comprising:

a. a support disk;

b. means for affixing said support disk to said rotating shaft so that said support disk is maintained in a substantially perpendicular relationship with said shaft; and c. a plurality of impeller blades affixed to said support disk and extending outwardly therefrom, each of said impeller blades having an upper edge which lies in a plane substantially parallel to said support disk, and each of said impeller blades being tapered causing said blades to be widest at the portion closest to said rotating shaft and progressively more narrow as said blade extends outwardly from said support disk wherein each of said impeller blades is curved along its entire length in the outward direction, and wherein each of said impeller blades includes a flow inducing fin along the lower edge of the blade, said fins being tapered so as to be widest at the portion closest to said rotating shaft and progressively more narrow as said blade extends outwardly from said support disk.

2. An impeller as set forth in claim 1, wherein each of said impeller blades includes a notch in the inner edge thereof which is adapted to receive the circular outer edge of said support disk so that said blades may be securely fastened to said support disk in a dovetail fashion.

3. An impeller as set forth in claim 2, wherein said blades are permanently affixed to said support disk.

4. An impeller for aerating a liquid and adapted to be affixed to a rotating shaft, comprising:

a. a support disk having a circular outer edge and upper and lower surfaces;

b. means for affixing said support disk to said rotating shaft so that said support disk is maintained in a substantially perpendicular relationship with said shaft;

c. a plurality of impeller blades affixed to said support disk in such a manner as to be spaced from said shaft when said support disk is affixed to said shaft, said impeller blades extending outwardly from said circular outer edge, and extending above said upper disk surface and below said lower disk surface, wherein each of said impeller blades has an upper edge which lies in a plane substantially parallel to said support disk and each of said impeller blades being tapered causing said blades to be widest at the portion closest to said rotating shaft and progressively more narrow as said blades extends radially outwardly from said support disk, and wherein each of said impeller blades includes a flow inducing fin along the lower edge of the blade, said fins being tapered so as to be widest at the portion closest to said rotating shaft and progressively more narrow as said blade extends outwardly from said support disk; and d. cover means, affixed to said impeller blades and spaced from said upper disk surface, for creating an air intake opening above said upper disk surface and for reducing the amount of splashing caused by the rotation of said impeller near the surface of said liquid.

* * * * *